US006971949B2

(12) United States Patent
Gleason

(10) Patent No.: US 6,971,949 B2
(45) Date of Patent: Dec. 6, 2005

(54) SHARPENING GUIDE FOR DENTAL TOOLS

(76) Inventor: Roger Gleason, 6135 NW. Hickory Pl., Parkville, MO (US) 64152

( * ) Notice: Subject to any disclaimer, the term of this patent is extended or adjusted under 35 U.S.C. 154(b) by 0 days.

(21) Appl. No.: 11/034,159

(22) Filed: Jan. 12, 2005

(65) Prior Publication Data

US 2005/0130567 A1 Jun. 16, 2005

Related U.S. Application Data

(63) Continuation of application No. 09/468,871, filed on Dec. 22, 1999, now Pat. No. 6,852,014.

(51) Int. Cl.[7] ..... B24B 7/00

(52) U.S. Cl. ..... 451/234; 451/231; 451/319; 451/555; 76/82; 83/174

(58) Field of Search ..... 451/45, 282–321, 451/371, 196, 198, 203–206, 224, 229, 234, 451/249, 213, 322, 555, 556, 231, 233; 83/174, 83/174.1; 76/82, 88

(56) References Cited

U.S. PATENT DOCUMENTS

| | | | | |
|---|---|---|---|---|
| 899,140 | A | * | 9/1908 | Spafford |
| 899,213 | A | * | 9/1908 | Fitzgerald |
| 939,365 | A | | 11/1909 | Wiethoff |
| 1,130,695 | A | * | 3/1915 | Allen |
| 1,391,763 | A | | 9/1921 | Dickinson |
| 1,950,824 | A | | 3/1934 | Suter |
| 2,165,929 | A | | 7/1939 | Lentz |
| 2,287,910 | A | | 6/1942 | Slack |
| 2,324,025 | A | | 7/1943 | Revell |
| 2,380,988 | A | | 8/1945 | Mudler |
| 2,549,263 | A | | 4/1951 | Thompson |
| 2,743,561 | A | * | 5/1956 | Franks |
| 2,864,206 | A | | 12/1958 | Lane et al. |
| 3,755,970 | A | | 9/1973 | Parr ..... 51/58 |
| 4,078,338 | A | | 3/1978 | Baughcom ..... 51/221 |
| 4,509,268 | A | | 4/1985 | Marquam et al. ..... 33/201 |
| 4,821,462 | A | | 4/1989 | Moore ..... 51/214 |
| 4,912,881 | A | | 4/1990 | McDougall ..... 51/157 |
| 5,197,227 | A | | 3/1993 | Svanberg ..... 51/125 |

(Continued)

OTHER PUBLICATIONS

Cutting Edge Technology, L.L.C. publication, entire document (6 pages).

(Continued)

*Primary Examiner*—Eileen P. Morgan
(74) *Attorney, Agent, or Firm*—Thomte, Mazour & Niebergall; Shane M. Niebergall

(57) ABSTRACT

A sharpening guide for a dental tool is provided, with the dental tool having a handle, a working portion, and a shank extending between the handle and the working portion. The sharpening guide includes a guide body and at least one opening formed in the guide body and extending into the guide body, with the at least one opening having an opening bottom, with the opening having at least one side wall and an opposing side wall portion, with the at least one side wall having a predetermined height in relation to the opening bottom and further having a predetermined distance from the opposing side wall portion, wherein when the shank of the dental tool is positioned against the at least one side wall and when the working portion of the dental tool contacts the opposing side wall portion and contacts the opening bottom, the sharpening guide positions the dental tool at a predetermined angle created by the predetermined height and the predetermined distance in order to correctly sharpen the working portion of the dental tool.

19 Claims, 11 Drawing Sheets

U.S. PATENT DOCUMENTS

| | | | | | |
|---|---|---|---|---|---|
| 5,295,328 | A | * | 3/1994 | Olbrich | |
| 5,426,999 | A | | 6/1995 | Seiler et al. | 76/82 |
| 5,487,693 | A | | 1/1996 | Prusaitis et al. | 451/45 |
| 5,505,656 | A | | 4/1996 | Moore | 451/540 |
| 5,520,574 | A | | 5/1996 | Wilson | 451/540 |
| 5,655,957 | A | | 8/1997 | Lystager | 451/278 |
| 5,667,434 | A | | 9/1997 | Prusaitis et al. | 451/552 |
| 5,700,184 | A | * | 12/1997 | Domenella | |
| 6,074,293 | A | * | 6/2000 | Bleier | 451/558 |
| 6,146,257 | A | * | 11/2000 | Himeno et al. | |

OTHER PUBLICATIONS

Hu-Friedy Dept. of Professional Education, Hu-Friedy, Inc., *Smarten Up, Sharpen Up—A Practical Workbook on Sharpening Dental Curets and Scalers*, 1982, entire document (105 pages), see pp. 11-16, 22-24, 34-36, 39-66, 72-74 and 78-100.

Product Catalog & Reference Guide, Second Edition, Hu-Friedy, Inc. publication, entire document (249 pages), see pp. 7 and G2-G10.

* cited by examiner

SHARPENING GUIDE FOR DENTAL TOOLS

This application is a continuation of prior application Ser. No. 09/468,871, filed Dec. 22, 1999 now U.S. Pat. No. 6,852,014.

BACKGROUND OF THE INVENTION

1. Field of the Invention

The present invention relates generally to a sharpening guide for a dental tool.

2. Description of the Background Art

Dentistry relies upon a wide variety of tools and appliances in order to maintain good dental health. These tools range from the basic to the sophisticated, but even the basic tools serve important functions. Included in such basic tools are scalers and curettes. They are used for cleaning teeth, and are therefore designed to reach into all spots in and around the teeth. They have sharpened edges that may be used to scrape teeth to remove plaque, tartar, and calculus.

Because scalers and curettes are important to dental health, it is important that they be kept in a good working condition. Part of this is a proper sharpening of any working edges.

Related art sharpening devices can be characterized as either hand sharpening or motorized sharpening. A first general category of hand sharpening devices is the freehand sharpening devices. Several types of freehand sharpening devices exist, as in Prusaitis et al., U.S. Pat. Nos. 5,487,693 and 5,667,434. Suter, U.S. Pat. No. 1,950,824, and Wilson, U.S. Pat. No. 5,520,574. Wilson includes an abrasive surface having a groove and rounded exterior surfaces meant to impart a desired angle, but does not guide the tool angle relative to the abrasive surface. Freehand sharpening is undesirable because of the high probability of sharpening the dental tool improperly and at incorrect angles. This may result in damage to the dental tool.

A second type of sharpening device is an angle gauge which gives a visual guide as the dental tool is sharpened on an abrasive surface. Several such devices are given in Marguam et al., U.S. Pat. No. 4,509,268, Seiler et al., U.S. Pat. No. 5,426,999, and Moore, U.S. Pat. Nos. 4,821,462 and 5,505,656. These devices have obvious drawbacks in that the visual indicator, while helpful, does not in any way constrain or guide the motion of the dental tool in relation to the abrasive surface.

A third related art sharpening guide approach is a device in which the dental tool may be clamped or held, and the device and dental tool are moved in relation to the abrasive surface. Several such devices are given in Revell, U.S. Pat. No. 2,324,025, Slack, U.S. Pat. No. 2,287,910, Wiethoff, U.S. Pat. No. 939,365, and Lentz, U.S. Pat. No. 2,165,929.

The clamping or holding approach has a drawback. The clamped dental tool is necessarily sharpened as a planar face, and a curved working portion may not be accommodated and properly sharpened. Continued use of such a device may result in undesirable flat faces or planes on the working portion of a dental tool.

Machine sharpening of dental tools typically are similar to the clamping or holding approach, with the addition of a motorized grinding wheel. Machine sharpening devices are given in Lystager, U.S. Pat. No. 5,655,957, Svanberg, U.S. Pat. No. 5,197,227, Thompson, U.S. Pat. No. 2,549,263, and Mudler, U.S. Pat. No. 2,380,988. In addition to the drawback of the clamped dental tool not being sharpened to accommodate curved surfaces, machine sharpening has additional drawbacks. First, because each tool is clamped and held in approximately the same location on the grinding wheel, the grinding wheel may "load up" and retain the material removed from the dental tool. Second, a proper clamp angle may need to be set for each tool to be sharpened. Resetting an angle or angles between different types of instruments may be complicated and time-consuming. Third, the coarseness of the stone may not be easily varied according to the dental tool or cutting edge, necessitating either multiple machines or changing the grinding wheel between dental tools. Fourth, motorized sharpening machines tend to be big, complex, and expensive.

There remains a need in the art, therefore, for an improved dental tool sharpening guide.

SUMMARY OF THE INVENTION

A sharpening guide for a dental tool is provided according to the invention, with the dental tool having a handle, a working portion, and a shank extending between the handle and the working portion. The sharpening guide comprises a guide body and at least one opening formed in the guide body and extending into the guide body, with the at least one opening having an opening bottom, with the opening having at least one side wall and an opposing side wall portion, with the at least one side wall having a predetermined height in relation to the opening bottom and further having a predetermined distance from the opposing side wall portion, wherein when the shank of the dental tool is positioned against the at least one side wall and when the working portion of the dental tool contacts the opposing side wall portion and contacts the opening bottom, the sharpening guide positions the dental tool at a predetermined angle created by the predetermined height and the predetermined distance in order to correctly sharpen the working portion of the dental tool.

The above and other features and advantages of the present invention will be further understood from the following description of the preferred embodiment thereof, taken in conjunction with the accompanying drawings.

DETAILED DESCRIPTION OF THE PREFERRED EMBODIMENTS

Figure 1:
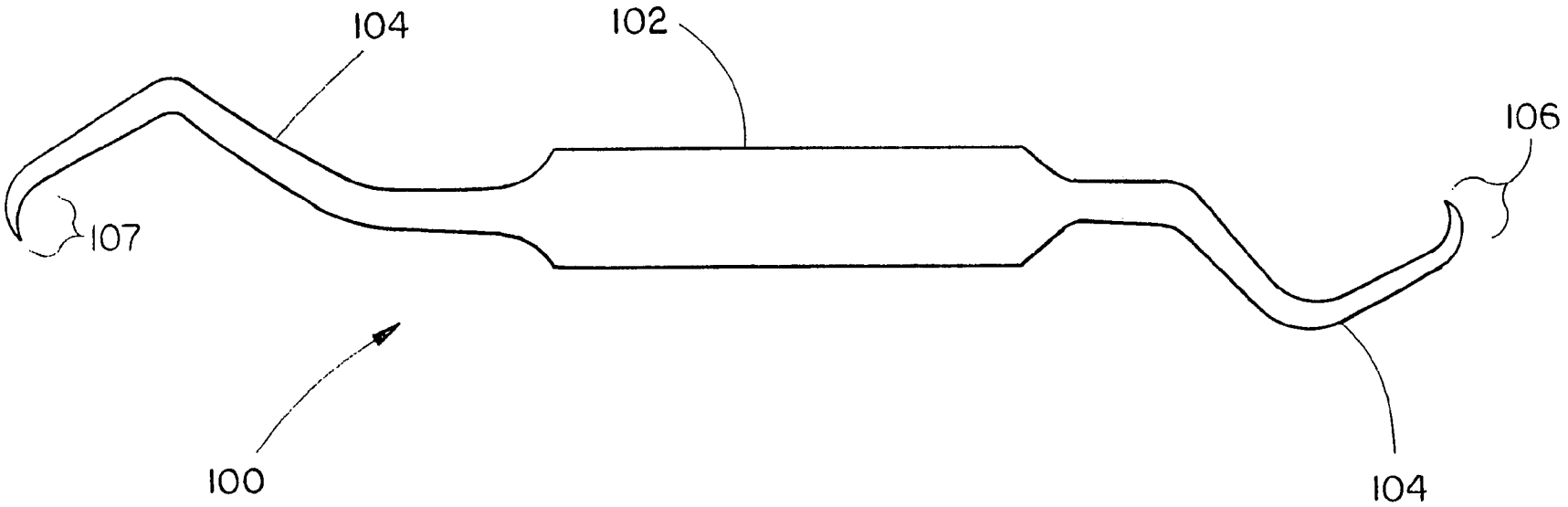
FIG. 1 shows a typical dental tool.

FIG. 1 shows a typical dental tool 100. The dental tool 100 includes a body 102, and a shank 104 and a working portion 107 provided on each end of the body 102. The dental tool may be held by the body 102 with the working portion 107 being used to perform functions such as the cleaning of teeth.

Figure 2A:
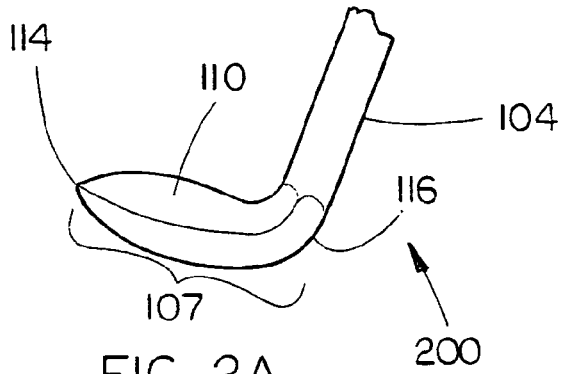
FIGS. 2A and 2B show a straight sickle scaler.
Figure 2B:
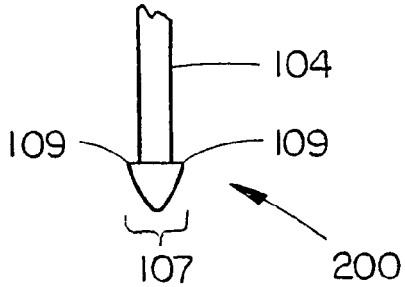

FIGS. 2A and 2B show a dental tool 100 that is typically referred to as a straight sickle scaler 200. The straight sickle scaler 200 includes a shank 104 and a working portion 107. The working portion 107 has a somewhat rounded bottom and a flat face 110, and includes sharpened edges 109. The working portion 107 is essentially straight from the toe 114 to the heel 116.

Figure 3A:
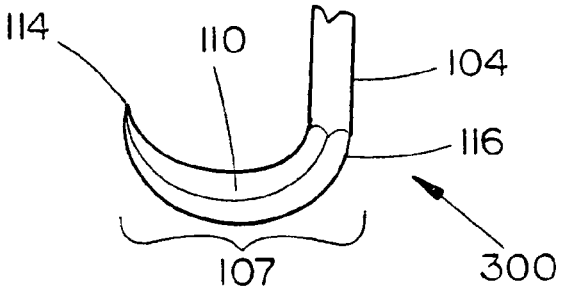
FIGS. 3A and 3B show a curved sickle scaler.
Figure 3B:
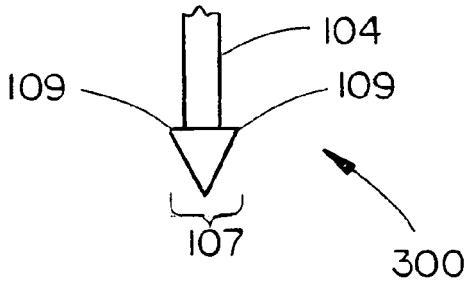

FIGS. 3A and 3B show a dental tool 100 that is typically referred to as a curved sickle scaler 300. As can be seen from FIG. 3B, the working portion 107 is triangular in cross-section and has sharpened edges 109.

Figure 4A:
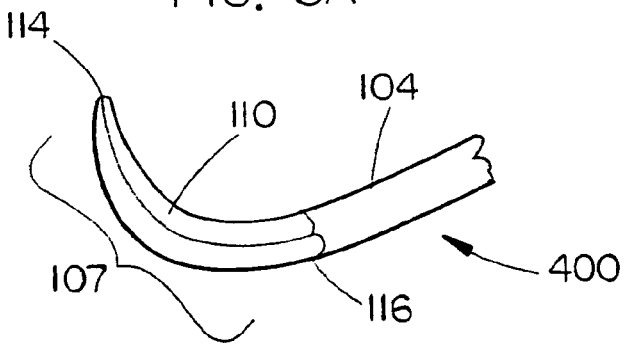
FIGS. 4A and 4B show a universal curette.
Figure 4B:
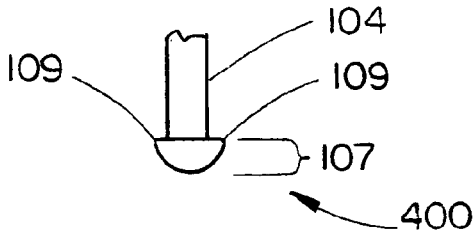

FIGS. 4A and 4B show a dental tool 100 that is typically referred to as a universal curette 400. The working portion 107 is curved between the heel 116 and the toe 114. The cross-section of the working portion 107 is semi-circular and has sharpened edges 109.

Figure 5A:
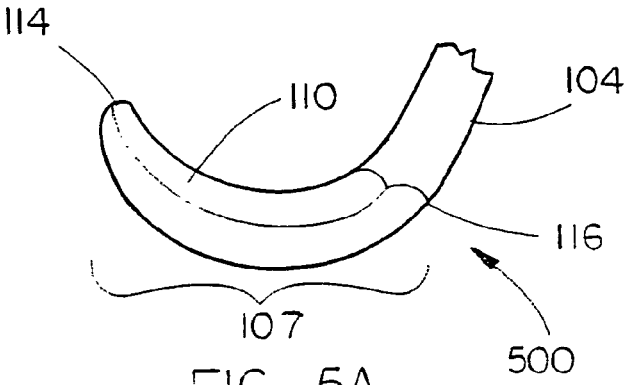
FIGS. 5A and 5B show a Gracey curette.
Figure 5B:
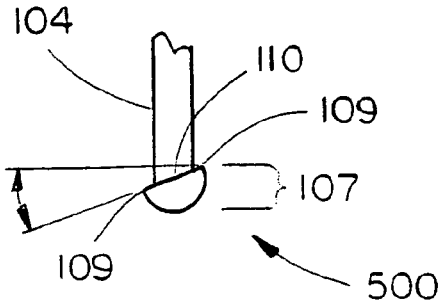

FIGS. 5A and 5B show a dental tool 100 that is typically referred to as a Gracey curette 500. Again, the working portion 107 is curved and has the semi-circular cross-section of the universal curette 300. However, unlike the universal curette 400, the face 110 of the Gracey curette 500 is angled from the horizontal when the shank 104 is held in a vertical position. The angle is typically about 20 degrees from horizontal, but may be varied.

Figure 6A:
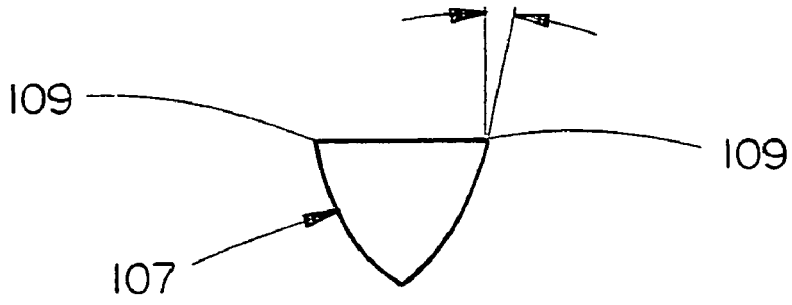
FIG. 6A shows a working portion that comes from the manufacturer, having desired sharpened edges.

FIG. 6A shows a working portion 107 that comes from the manufacturer, having desired sharpened edges 109. The original sharpened edges 109 should be maintained in order to most effectively use the dental tool 100.

Figure 6B:
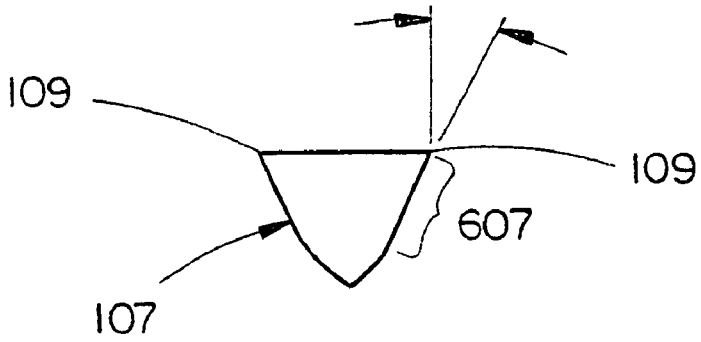
FIG. 6B shows the working portion wherein the sharpened edge has been sharpened at too great an angle from vertical.

FIG. 6B shows the working portion 107 wherein a sharpened edge 109 has been sharpened at too great an angle from vertical. This results in a large, flat face 607, and the sharpened edge 109 is too thin and pointed. As a result, the sharpened edge 109 may wear and dull quickly, may tend to break and become jagged and irregular, or may be too sharp for safe use.

Figure 6C:
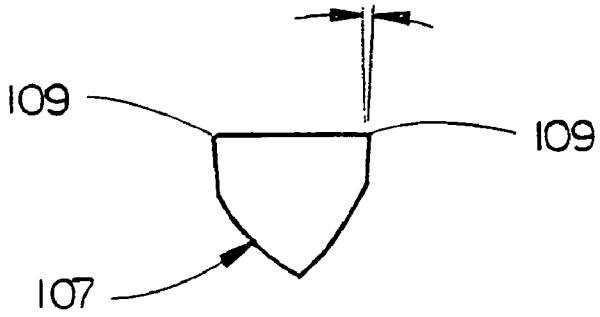
FIG. 6C shows a working portion wherein the sharpened edge has been sharpened at too small an angle from vertical.

FIG. 6C shows a working portion 107 wherein the sharpened edge 109 has been sharpened at too small an angle from vertical. As a result, the sharpened edge 109 has been mostly removed and is fairly dull even when freshly sharpened. This sharpened edge 109 will have difficulty in removing deposits.

Figure 7A:
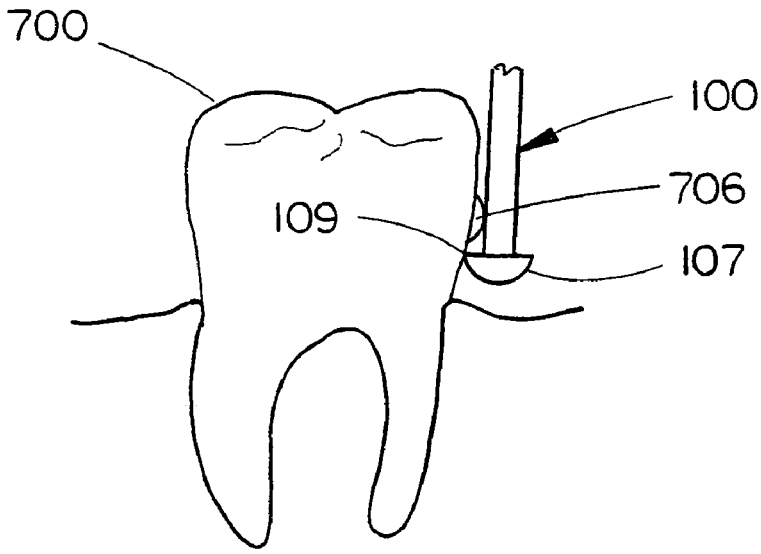
FIG. 7A shows how the dental tool may be used to scrape a deposit off of a tooth.
Figure 7B:
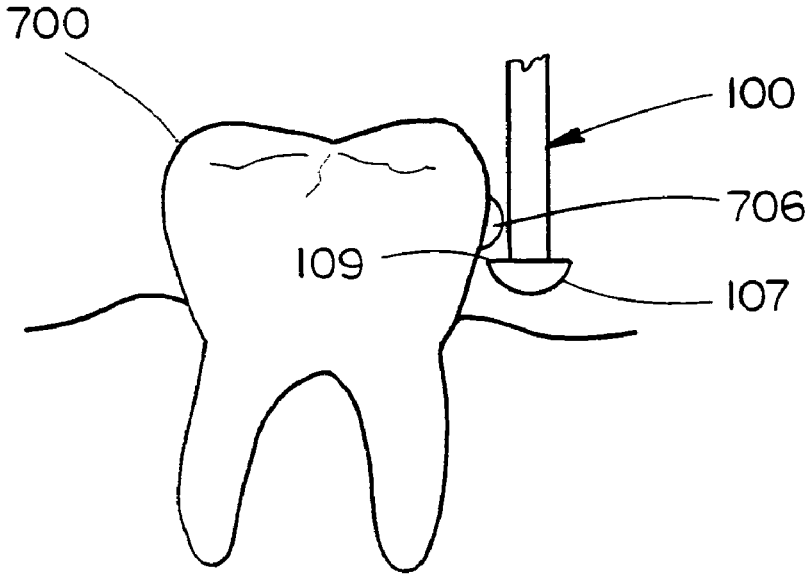
FIG. 7B shows the dental tool wherein the sharpened edge has been improperly sharpened or has worn excessively and is in need of sharpening.

FIG. 7A shows how a dental tool 100 may be used to scrape a deposit 706 off of a tooth 700. The working portion 107 is held and moved in such a manner that the sharpened edge 109 contacts the deposit 706 and scrapes it off of the tooth 700. FIG. 7B shows a dental tool 100 wherein the sharpened edge 109 has been improperly sharpened or is excessively worn, and is not at an optimum sharpness or angle. Therefore, when the dental tool 100 is scraped across the tooth 700, the improperly shaped or sharpened edge 109 might not remove all of the deposit 706.

Figure 8A:
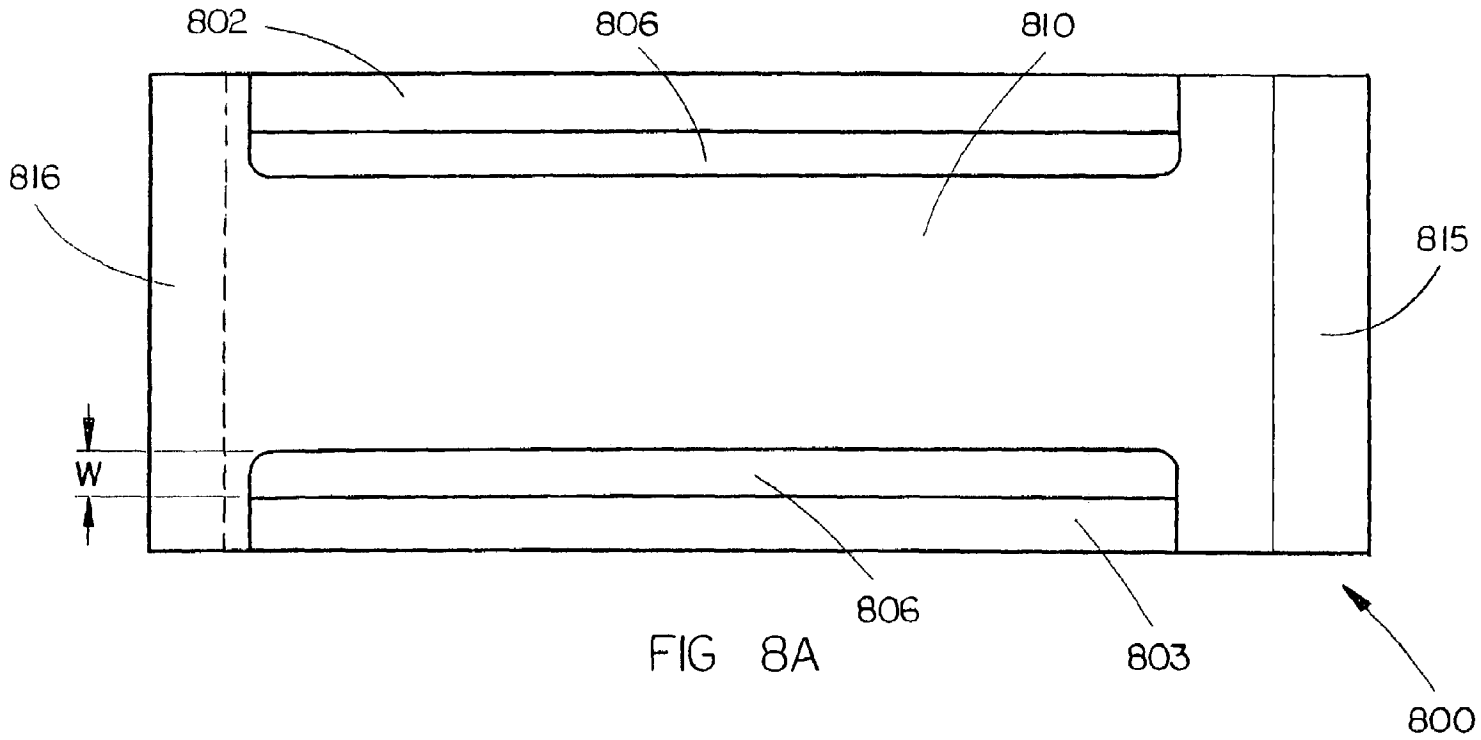
FIGS. 8A–8B show top and side views of the dental sharpening guide of the present invention.
Figure 8B:
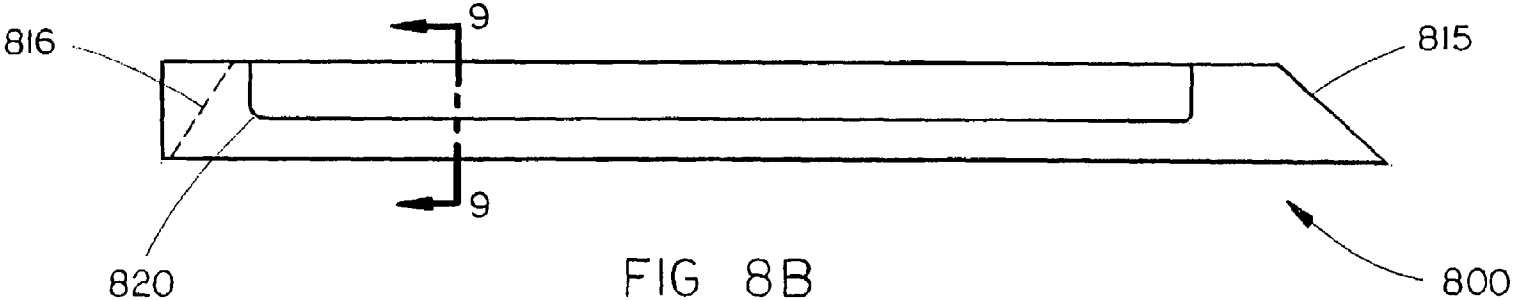

FIGS. 8A–8B show top and side views of the dental sharpening guide 800 of the present invention. The dental sharpening guide 800 is generally rectangular in shape and has a predetermined thickness. The overall shape is not important, and may be varied. However, in a preferred embodiment the sharpening guide 800 is small enough to be used chairside by a dental professional.

The sharpening guide 800 may be formed of a variety of materials. In the preferred embodiment, the sharpening guide 800 is formed of stainless steel in order that the sharpening guide 800 be easily disinfected and sterilized. This allows a dental professional to touch up a cutting edge during use. However, the sharpening guide may alternatively be formed of any type of metal or plastic.

Figure 17:
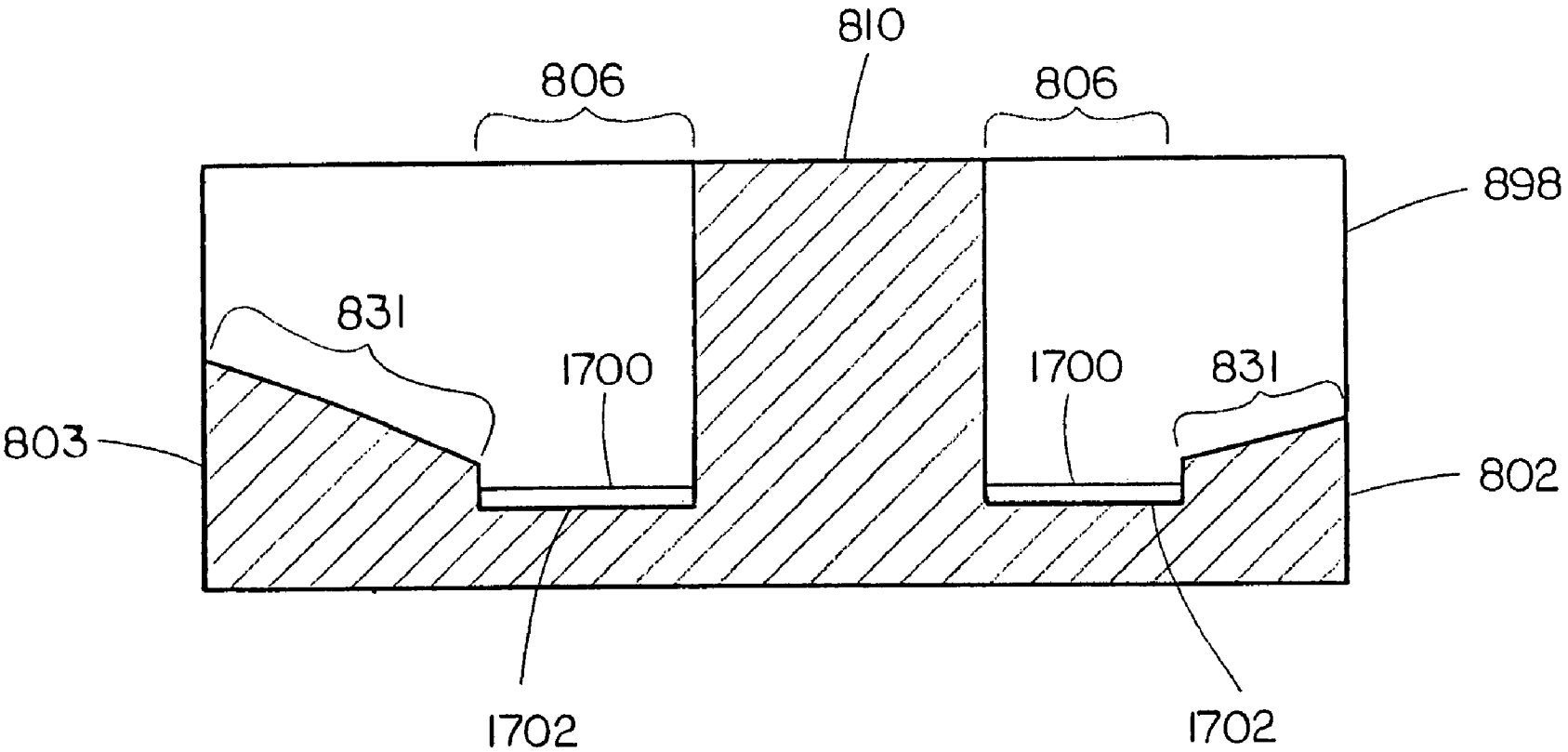
FIG. 17 shows a ninth embodiment of the dental sharpening guide.

A first end 815 and optionally a second end 816 may be beveled for use in sharpening the toe 114 of the dental tool 100 (see discussion accompanying FIG. 17). Of course, any edge or edge portion of the sharpening guide 800 may be beveled.

Also included in the sharpening guide 800 are one or more openings 806. Each opening 806 may have distinct dimensions. In the preferred embodiment two openings 806 are provided. Each opening 806 has a predetermined width W and at least one side wall of a predetermined height in relation to the abrasive surface 909 (see FIG. 9), and an opposing side wall portion. This is further illustrated in FIGS. 9–15, where an outer web 802 or 803 may be the side wall and the central web 810 may be the opposing side wall portion. The outer webs 802 and 803 may be formed with rounded corners 820 as shown, or may have substantially square corners.

It should be understood that the openings 806 may be formed of any desired shape, such as substantially circular, substantially ovoid, substantially rectangular, or substantially irregular. The two openings 806 are positioned between outer webs 802 and 803 and a central web 810. A cross-section AA, illustrating the profiles of the webs, will be discussed below in the various embodiments.

When the shank 104 of the dental tool 100 is positioned against one side wall and the working portion 107 of the dental tool 100 contacts the opposing side wall portion and contacts the abrasive surface 909, the sharpening guide 800 positions the dental tool 100 at a predetermined angle created by the predetermined height of the side wall to correctly sharpen the working portion 107 of the dental tool 100 (see discussion accompanying FIG. 9 below).

Figure 9:
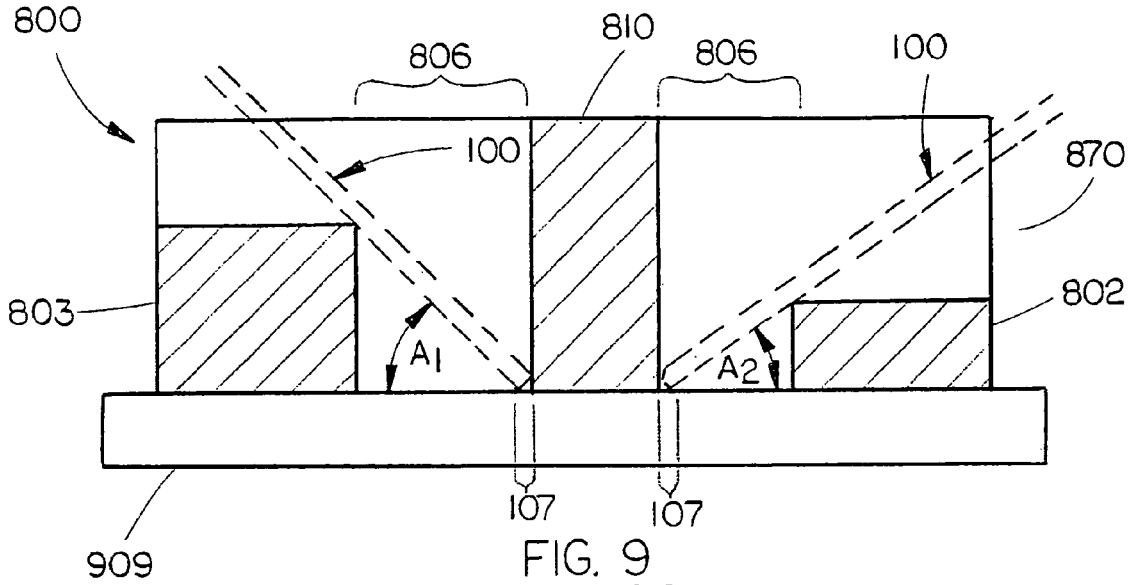
FIG. 9 shows a first embodiment of the dental sharpening guide.

FIG. 9 shows a first embodiment 870 of the dental sharpening guide. In the first embodiment 870, the outer webs 802 and 803 are substantially rectangular in cross-sectional shape and are each of a predetermined height. The angles $A_1$ and $A_2$ are determined by the width of the openings 806 and the heights of the outer webs 802 and 803.

As can be seen from the figure, the dental sharpening guide 800 may be placed upon an abrasive surface 909 (such as a sharpening stone, for example) in preparation for use. Alternatively, the sharpening guide 800 may be permanently or removably affixed to the abrasive surface 909. The dashed lines represent possible positions of the dental tool 100. As can be seen from the dashed lines, the dental tool 100 may rest against one of the outer webs 802 or 803, with the working portion 107 resting against the bottom of the central web 810 and against the abrasive surface 909. The dental sharpening guide 800 supports the shank 104 of the dental tool 100 at a predetermined angle so that a sharpened edge 109 may be sharpened by contact with the abrasive surface 909. In use, the dental sharpening guide 800 is held in position on the abrasive surface 909 and the dental tool 100 is moved (in a opening 806) in a reciprocating motion.

The sharpening guide 800 may be repositioned on the abrasive surface 909 periodically to utilize additional surface regions of the abrasive surface 909, and thereby eliminating loading of the abrasive surface 909.

Figure 10A:
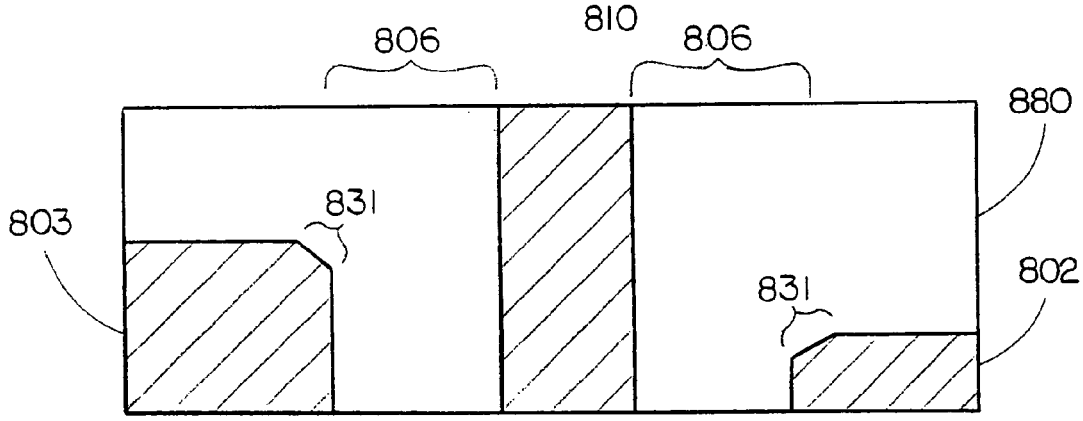
FIG. 10 shows a second embodiment of the dental sharpening guide.
Figure 10B:
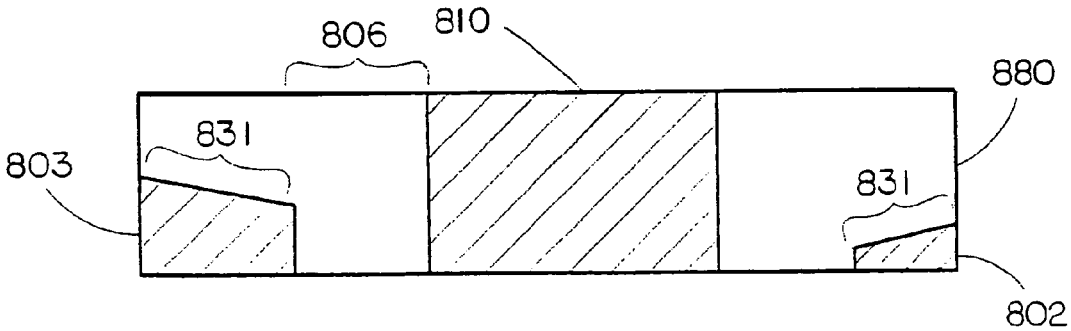

FIGS. 10A and 10B show a second embodiment 880 of the dental sharpening guide. In the second embodiment 880, the outer webs 802 and 803 each have a bevel 831. This bevel 831 provides a greater contact surface between the dental tool 100 and the respective web 802 or 803, providing greater guidance during sharpening and reducing wear on the shank 104 of the dental tool 100. In FIG. 10B, the bevel extends fully across the tops of the outer webs 802 and 803.

Figure 11:
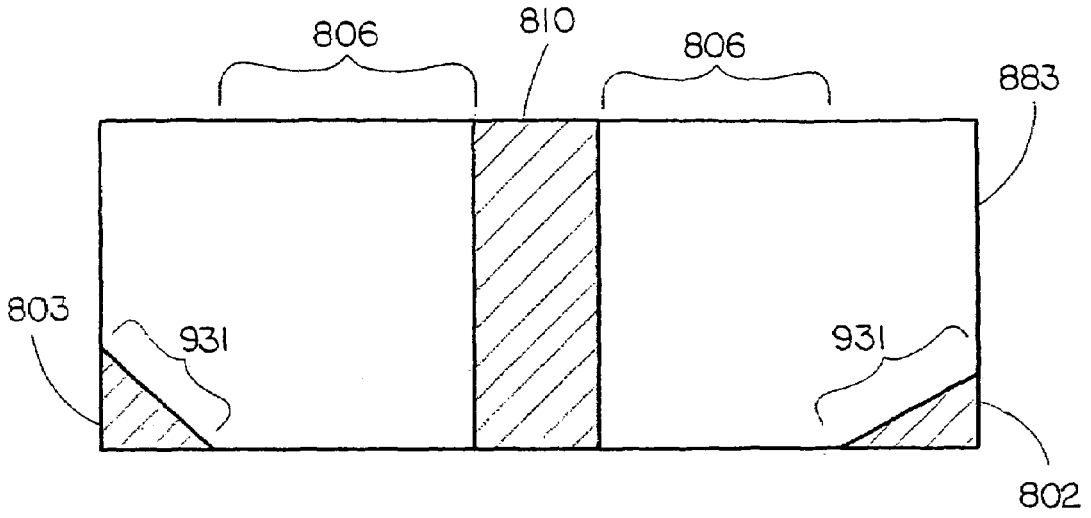
FIG. 11 shows a third embodiment of the dental sharpening guide.

FIG. 11 shows a third embodiment 883 of the dental sharpening guide. In the third embodiment 883, the outer webs 802 and 803 each have a completely beveled face 931.

Figure 12:
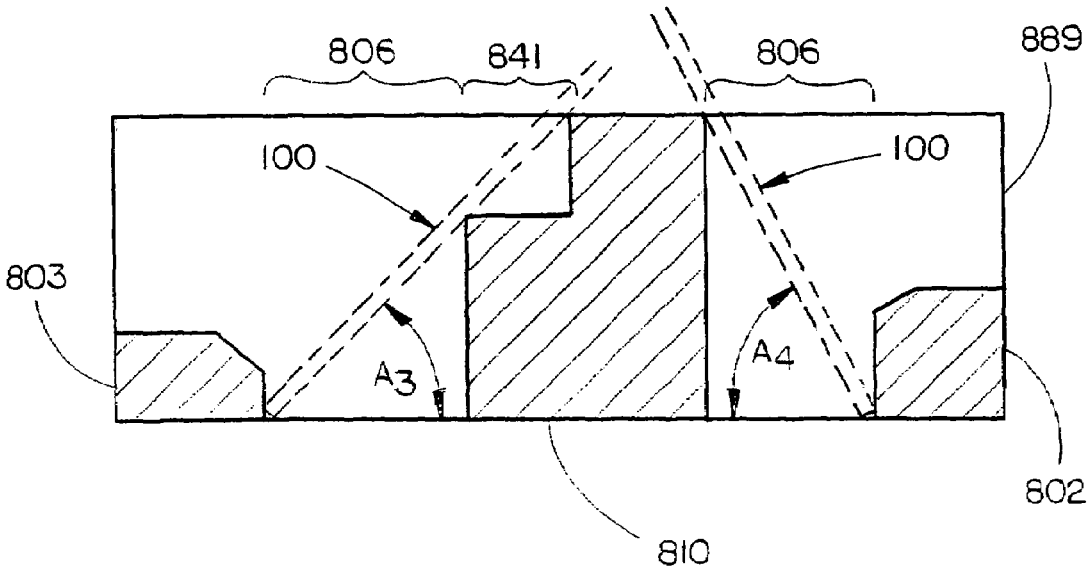
FIG. 12 shows a fourth embodiment of the dental sharpening guide.

FIG. 12 shows a fourth embodiment 889 of the dental sharpening guide. In the fourth embodiment 889, the central web 810 may include a cut-out portion 841, therefore allowing the use of the central web 810 to determine the additional sharpening angles $A_3$ and $A_4$. It should be understood that angles $A_3$ and $A_4$ may be distinct from angles $A_1$ and $A_2$. Similar to the angles $A_1$ and $A_2$, the angles $A_3$ and $A_4$ are determined by the height of the central web 810 and the width of the openings 806. It should be understood that the cut-out portion 841 is not strictly necessary, as the widths of the openings 806 may be varied in order to create distinct angles $A_3$ and $A_4$.

Figure 13:
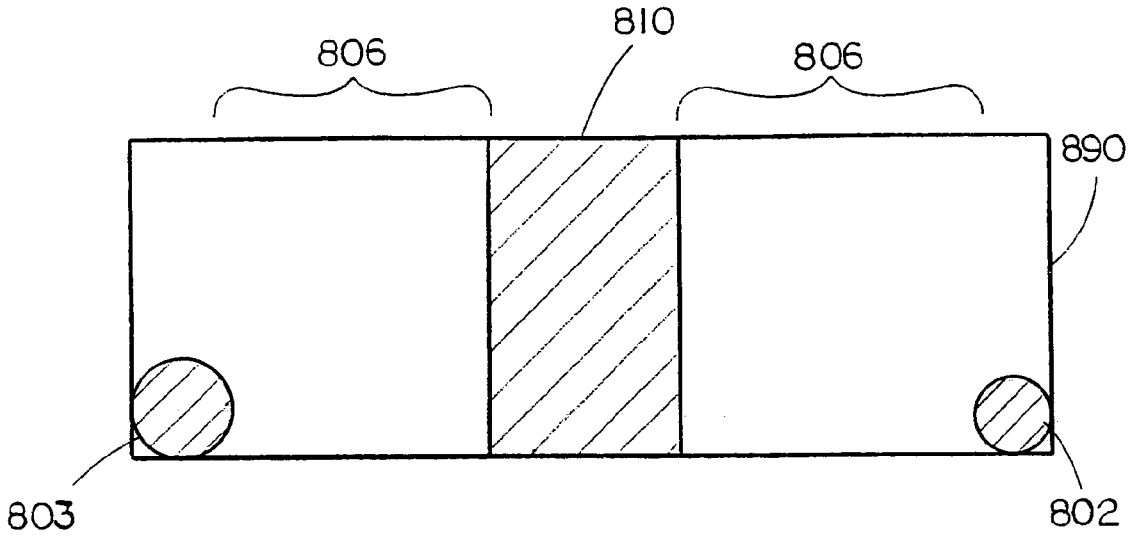
FIG. 13 shows a fifth embodiment of the dental sharpening guide.

FIG. 13 shows a fifth embodiment 890. In the fifth embodiment 890, the outer webs 802 and 803 are substantially circular in shape. Their respective diameters determine the sharpening angles of the dental tool 100.

Figure 14:
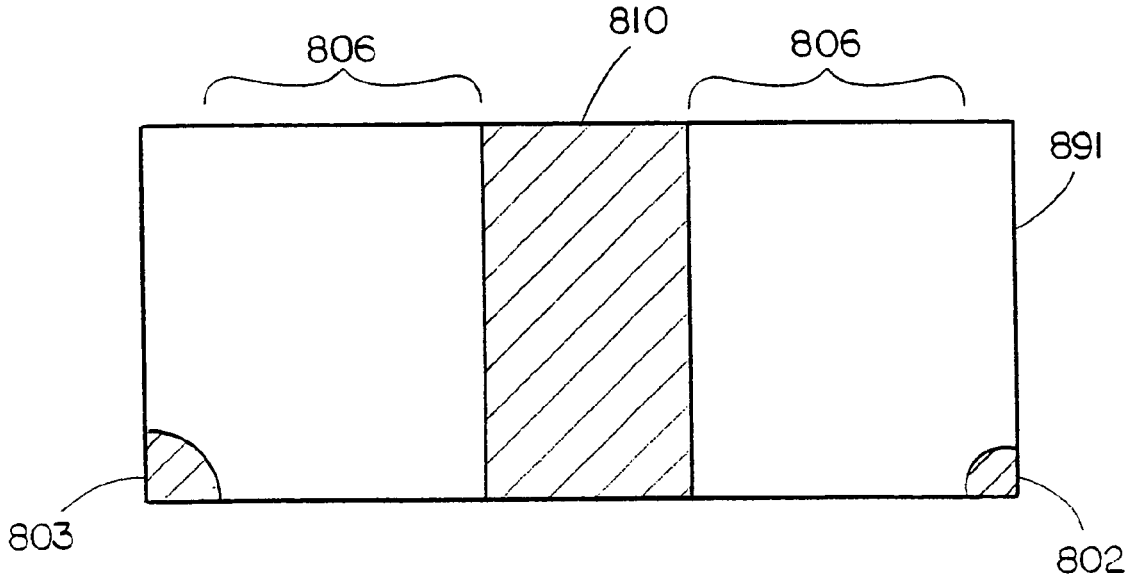
FIG. 14 shows a sixth embodiment of the dental sharpening guide.

FIG. 14 shows a sixth embodiment 891. In the sixth embodiment 891, the outer webs 802 and 803 have a substantially circular face 831.

Figure 15:
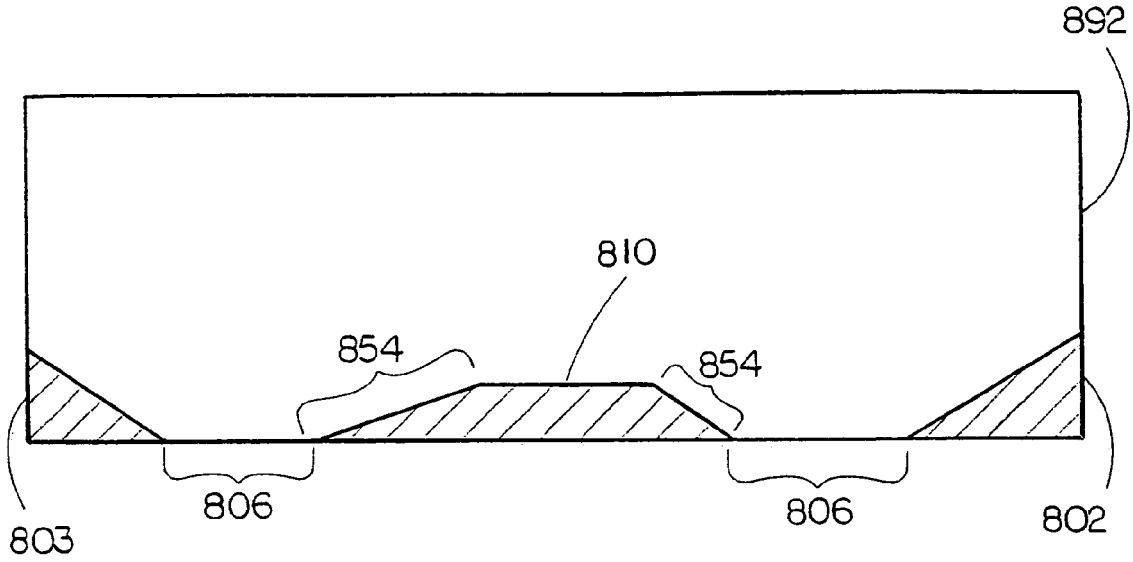
FIG. 15 shows a seventh embodiment of the dental sharpening guide.

FIG. 15 shows a seventh embodiment 892 of the dental sharpening guide. In the seventh embodiment 892, the central web 810 does not extend the full height of the sharpening guide 892, and also may include beveled faces 854. Therefore, four different surfaces exist against which the dental tool 100 may be placed during sharpening.

Figure 16:
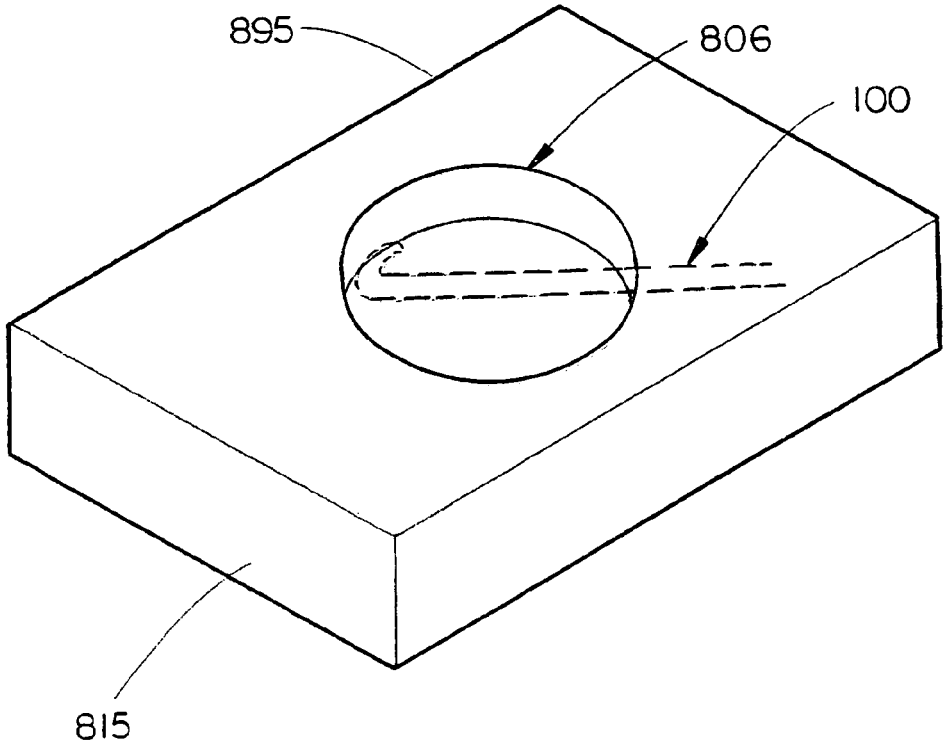
FIG. 16 shows a eighth embodiment of the dental sharpening guide.

FIG. 16 shows a eighth embodiment 895 of the dental sharpening guide. In this embodiment, the opening 806 is substantially circular. As in the previous embodiments, the shank 104 of the dental tool 100 is placed in contact with an upper edge of one wall and a lower edge of an opposing side wall portion in order to set the sharpening angle.

FIG. 17 shows a ninth embodiment 898 of the dental sharpening guide. In the ninth embodiment 898, the entire sharpening guide may be formed of an abrasive material having openings or depressions 806 and contact surfaces 831 which determine sharpening angles. The openings 806 may extend only partially into the sharpening guide 898 and may therefore have opening bottoms 1702. Alternatively, the sharpening guide 898 may be formed of metal or plastic and have either abrasive coating layers 1700 or abrasive material inserts 1700 (of predetermined thicknesses) located on the bottom surfaces of the depressions 806.

Figure 18:
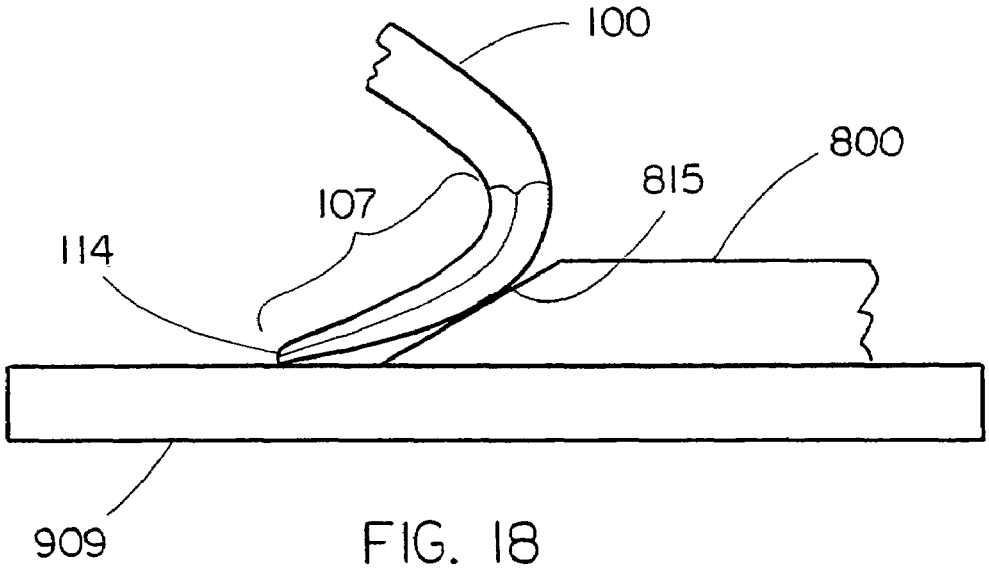
FIG. 18 shows the use of the sharpening guide for sharpening the toe of a dental tool.

FIG. 18 shows the use of the sharpening guide 800 for sharpening the toe 114 of a dental tool 100. To sharpen the toe 114, the working portion 107 contacts the beveled end 815 and the toe 114 contacts the abrasive surface 909. The dental tool 100 may be moved in a reciprocating (or substantially circular) motion along the beveled end 815. In the preferred embodiment, the beveled end 815 is at an angle of about 45 degrees from horizontal, but alternatively the beveled end 815 (and the optional beveled end 816) may be formed at an angle of about 20 degrees to about 70 degrees.

Figure 19:
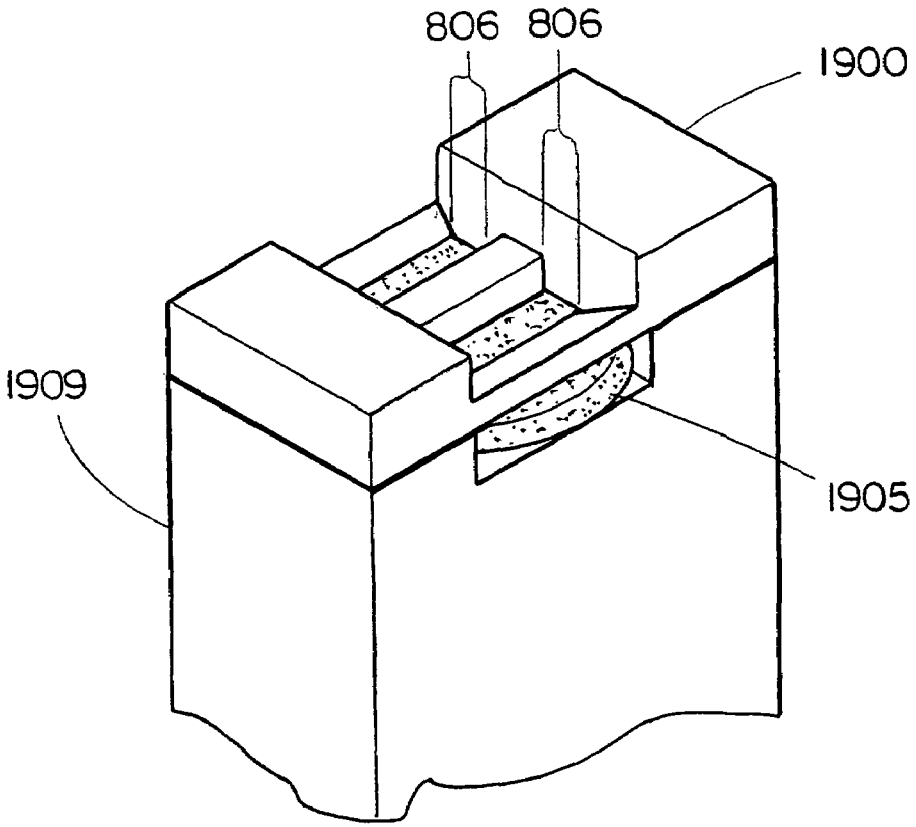
FIG. 19 shows a tenth embodiment that is adapted to be used with a power-driven sharpening abrasive.

FIG. 19 shows a tenth embodiment 1900 that is adapted to be used with a power-driven sharpening wheel or other such shape. The tenth embodiment 1900 may be placed on and optionally affixed to a power body 1909 having a rotating sharpening abrasive 1905 such as an abrasive wheel (or other movable abrasive). The power body 1909 and associated sharpening abrasive 1905 (or other movable abrasive) may be attached to a power source. Other embodiments may include a reciprocating abrasive or a linearly moving abrasive (not shown). Preferably, the power source is a pneumatic dental motor, such as that used for drilling teeth. The tenth embodiment 1900 includes openings 806 which, as previously described, may be used to guide a sharpening angle.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A sharpening tool for use in sharpening a working portion of a hand held dental tool having a handle, and a shank that extends between the handle and the working portion, said sharpening tool comprising:

a guide body, having a first side wall, a second side wall and an opposing side wall disposed between said first side wall and said second side wall; said first and opposing side walls defining a first opening through said guide body; said second and opposing side walls defining a second opening through said guide body;

a sharpening member operatively coupled with said guide body; said sharpening member having an abrasive surface;

said first side wall and said second side wall each having predetermined heights and each being positioned predetermined distances from said opposing side wall so that the sharpening tool will position the hand held dental tool at one of two different predetermined angles with respect to the abrasive surface when the shank of the hand held dental tool is positioned against said first side wall or the second side wall and the working portion of the hand held dental tool is positioned adjacent said opposing side wall and said abrasive surface.

2. The sharpening tool of claim 1, wherein said sharpening tool is adapted to be permanently affixed to said abrasive member.

3. The sharpening tool of claim 1, wherein said first side wall is provided with a curved engagement face that is positioned generally opposite said opposing side wall.

4. The sharpening tool of claim 1, wherein said first side wall further comprises an interior surface beveled at a select angle.

5. The sharpening tool of claim 1, wherein said opposing side wall is shaped to have a recess that extends a length of said opposite side wall and is open to a side surface and upper surface of said opposite side wall; said recess being shaped and positioned to support the hand held dental tool at an angle with respect to said abrasive surface when the shank of the hand held dental tool is positioned against said recess and the working portion of the hand held dental tool is positioned closely adjacent said abrasive surface.

6. The sharpening tool of claim 1, wherein said first side wall and at least a portion of said opposing side wall are curved so that said first opening is defined with a substantially curved shape.

7. The sharpening tool of claim 1, wherein said predetermined angle is selected to correctly sharpen a Gracey type dental tool.

8. The sharpening tool of claim 7, wherein said predetermined angle ranges from about 35 to about 45 degrees.

9. The sharpening tool of claim 6, further comprising a power body operatively coupled with said guide body; said power body having a power-driven element operatively coupled with a sharpening member.

10. The sharpening tool of claim 9, wherein said guide body is provided with at least one beveled peripheral surface adjacent said abrasive surface; said at least one beveled peripheral surface being disposed at a predetermined angle with respect to said abrasive surface for sharpening a toe of the working portion of the hand held dental tool.

11. The sharpening tool of claim 1, wherein said second side wall is provided with a curved engagement face that is positioned generally opposite said opposing side wall.

12. The sharpening tool of claim 1, wherein said predetermined angle is selected to correctly sharpen a sickle type dental tool.

13. The sharpening tool of claim 12, wherein said predetermined angle ranges from about 15 to about 25 degrees.

14. The sharpening tool of claim 1, wherein said predetermined angle is selected to correctly sharpen a universal type dental tool.

15. The sharpening tool of claim 1, wherein said guide body is provided with at least one beveled peripheral surface adjacent said abrasive surface; said at least one beveled peripheral surface being disposed at a predetermined angle with respect to said abrasive surface for sharpening a toe of the working portion of the hand held dental tool.

16. The sharpening tool of claim 1, further comprising a power body operatively coupled with said guide body; said power body having a power-driven element operatively coupled with a sharpening member.

17. The sharpening tool of claim 16, wherein said guide body is removably coupled with said power body.

18. The sharpening tool of claim 17, wherein said first side wall and at least a portion of said opposing side wall are curved so that said first opening is defined with a substantially curved shape.

19. A sharpening tool for use in sharpening a working portion of a hand held dental tool having a handle, and a shank that extends between the handle and the working portion, said sharpening tool comprising:

a guide body, having a first side wall and an opposing side wall; said first and opposing side walls defining an opening through said guide body;

a power body, having a power-driven sharpening abrasive, operatively coupled with said guide body; said sharpening abrasive having an abrasive surface positioned adjacent said first side wall and said opposing side wall;

said first side wall having a predetermined height and being positioned a predetermined distance from said opposing side wall so that the sharpening tool will position the hand held dental tool at a predetermined angle with respect to the abrasive surface when the shank of the hand held dental tool is positioned against said first side wall and the working portion of the hand held dental tool is placed in contact with said abrasive surface.

* * * * *